United States Patent [19]

Bisson

[11] Patent Number: 5,038,692

[45] Date of Patent: Aug. 13, 1991

[54] WHEEL LOW FABRIC FEEDING IN SEWING

[75] Inventor: Flavio Bisson, Cava Manara, Italy.

[73] Assignee: Necchi Macchine per Cucire S.r.l., Pavia, Italy

[21] Appl. No.: 394,947

[22] Filed: Aug. 17, 1989

Related U.S. Application Data

[63] Continuation-in-part of Ser. No. 239,001, Aug. 29, 1988, abandoned, which is a continuation-in-part of Ser. No. 56,891, Jun. 3, 1987, abandoned.

[30] Foreign Application Priority Data

Jul. 3, 1986 [IT] Italy ..... 42913 A/86

[51] Int. Cl.[5] ..... D05B 27/00

[52] U.S. Cl. ..... 112/316; 112/318; 112/317; 112/322

[58] Field of Search ..... 112/47, 316, 317, 318, 112/322

[56] References Cited

U.S. PATENT DOCUMENTS

| | | | |
|---|---|---|---|
| 1,278,204 | 9/1918 | Pierce | 112/317 X |
| 1,884,404 | 10/1932 | Van Ness et al. | 112/322 |
| 2,105,097 | 1/1938 | Poole | 112/47 |
| 2,263,414 | 12/1941 | Meyer | 112/322 |
| 2,885,983 | 5/1959 | Benink et al. | 112/318 |
| 3,960,097 | 6/1976 | Block | 112/322 |
| 4,719,867 | 1/1988 | Bisson | 112/318 |

*Primary Examiner*—Werner H. Schroeder
*Assistant Examiner*—Paul C. Lewis
*Attorney, Agent, or Firm*—Stevens, Davis, Miller & Mosher

[57] ABSTRACT

Wheel low fabric feeding for sewing machines where oscillations of the feeding shaft are transmitted to two gear couples mounted on free release wheels fixed to a support pivoted free to rotate. By acting on a stitch length regulator device one of these couples engages the feeding wheel for reversing the rotation direction of the wheel and thus the work feeding direction.

5 Claims, 3 Drawing Sheets

WHEEL LOW FABRIC FEEDING IN SEWING

This application is a continuation-in-part of application Ser. No. 239,001, filed Aug. 29, 1988, now abandoned, which is a continuation-in-part of application Ser. No. 056,891, filed June 3, 1987 now abandoned.

BACKGROUND OF THE INVENTION

The present invention relates to a wheel low fabric feeding for sewing machines.

In the wheel low fabric feedings, known in the art, free release wheel devices are provided on the feeding shaft for transmitting the oscillations of the shaft, in one direction, to the feeding wheel, as the wheel must rotate with intermittence when the needle is out of the work.

The sewing machines, on which the wheel low fabric feeding is mounted, are usually employed in the leather goods industry. In such a sector, when a sewing is executed, if the product does not require accurate finishing, the sewing may become unthreaded, as no kind of fixing is provided at the end and at the beginning of the same. For the high quality products, at the end of the sewing, the operator executes manually the initial and the final fixing of the sewing. More time is thus required for obtaining finished goods and consequently the cost of the goods is higher. In the traditional dog feeding sewing machines the above mentioned drawbacks are overcome by executing an initial and a final fixing of the sewing, that is at the beginning of a sewing the machine executes some stitches with forward work feeding, then the feeding is reversed and the same number of stitches is executed with backward work feeding, finally executing the sewing. The final fixing of the sewing is executed in a similar way. This is not possible in the sewing machines with wheel low fabric feeding, because, as previously stated, the oscillations of the feeding shaft are transmitted only in one direction to the feeding wheel as the wheel must rotate with intermittence in phase with the normal oscillations of the needle. It is the purpose of the present invention to overcome the above.

SUMMARY OF THE INVENTION

The technical problem to be solved was to obtain the initial and the final fixing of the sewing, that is to have a wheel feeding to which the feeding reversal could be applied maintaining the intermittence of the wheel.

The solution of the technical problem was accomplished by having the oscillations of the feeding shaft transmit via a lever to two gear couples mounted on free release wheels fixed to a support pivoting free to rotate on the sewing machine and means for engaging one of the gear couples to the low feeding wheel in order to reverse the rotational direction of the wheel.

BRIEF DESCRIPTION OF THE DRAWINGS

Other details and features of the invention will stand out from the description given below by way of non-limitative example and with reference to the accompanying drawings, in which.

DESCRIPTION OF THE PREFERRED EMBODIMENTS

Figure 1:
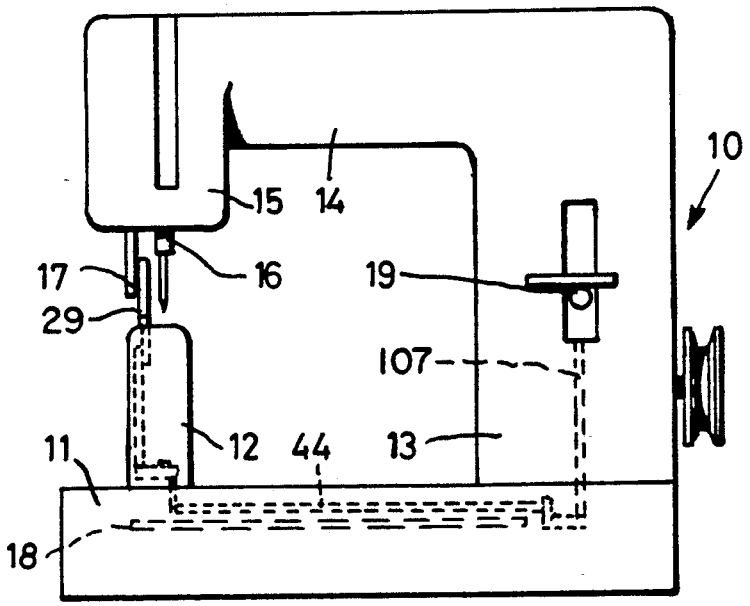
FIG. 1 illustrates a sewing machine to which the object of the present invention is applied.

With reference to FIG. 1 a sewing machine has been generally indicated as 10 comprising a bed 11, a column 12, a standard 13, a bracket arm 14 parallel to said bed 11 and ending with a head 15 from which a needle bar 16 and the wheel upper feeding 17 extend.

In the bed 11 there is placed the feeding shaft 18 which is caused to oscillate around its axis through known means not illustrated in the drawings.

Figure 7:
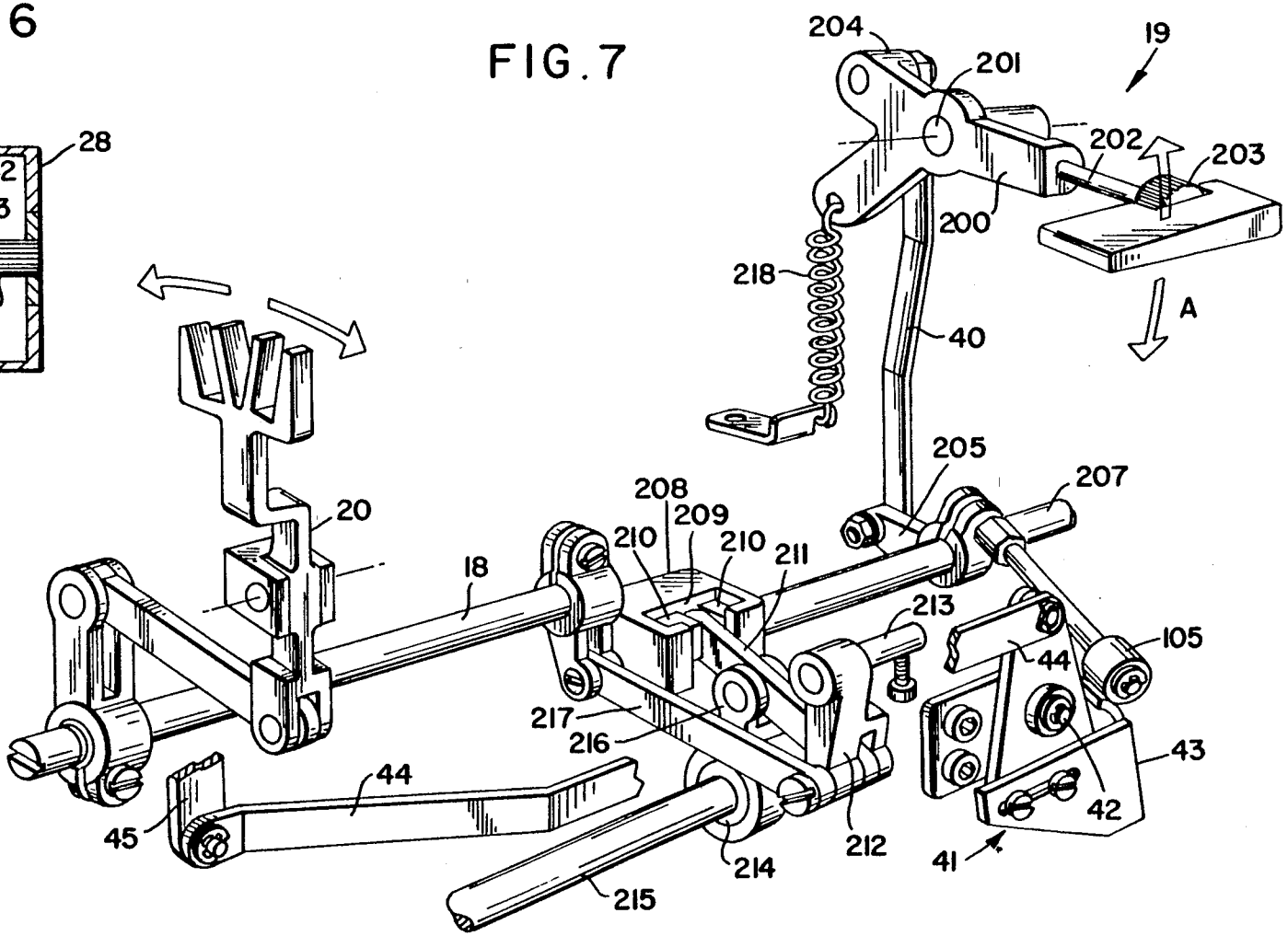
FIG. 7 shows a more detailed arrangement of the stitch length regulator.
Figure 6:
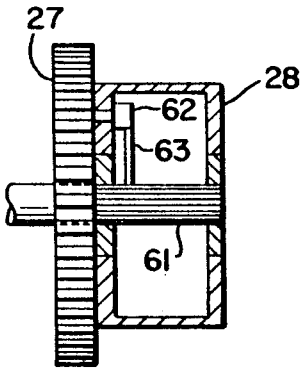
FIG. 6 shows a cross-sectional view of a free release wheel.

The width of the oscillations of the shaft 18 is controlled in a known way by the stitch length regulator indicated by 19 in FIGS. 1 and 7. The oscillations of the feeding shaft 18 are transmitted to a lever 20 (FIG. 2) which is pivoted, free to rotate, around a pin 21 fixed to the low portion of the column 12. The lever 20 presents at one end two forks 22 and 22' which are engaged by slide blocks 23 and 23', respectively, connected to one end of connecting rods 24 and 24'. The other end of the connecting rods 24 and 24' rotably mount free release wheels 25 and 25' which act on first gears 26 and 26'. Gears 26 and 26' are coupled to second gears 27 and 27' on which second free release wheels 28 and 28' respectively act, which prevent the gears 26 and 26' from rotating in the opposite direction with respect to their normal rotation when the connecting rods 24 and 24' are carried again into the work initial position by the oscillation of the lever 20. Free release wheels 25, 25', 28 and 28' each have an internal ratchet and pawl which limits the rotation of each of the gears 26, 26', 27 and 27' respectively to but one direction. Reference is made to FIG. 6 wherein gear 27 is shown with free release wheel 28, splined shaft 61, pawl 62 and spring 63 which holds pawl 62 in contact with splined shaft 61.

Figure 4:
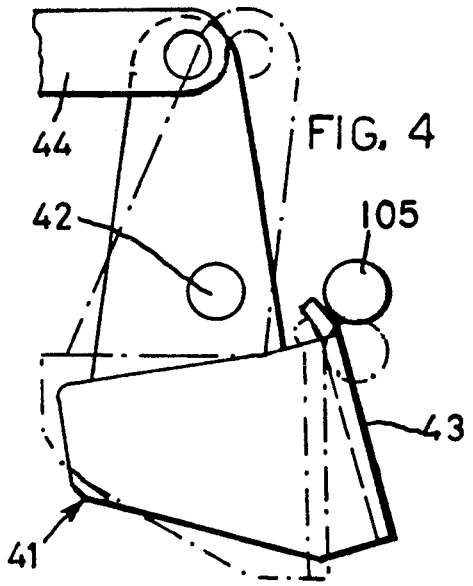

The coupled gears 26–27 rotate in a direction opposite to the coupled gears 26'–27' for the below explained reasons. By means of the above described free release wheel system, the gears 27 and 27' rotate with intermittence in opposite directions. The low feeding wheel 29 carries a gear 30 which is engaged either by the gear 27 or by the gear 27' depending on whether the work must be fed in the normal direction or in a backward direction. When the normal direction feeding occurs, the gear 27 is coupled with the gear 30 of the wheel 29. Thus the oscillations of the feeding shaft 18 via the lever 20, the connecting rod 24, the gears 26, 27 and 30, are transmitted to the wheel 29 which rotates with intermittence by means of the free release wheels 25 and 28. The stitch length regulator device 19 (FIGS. 1, 4 and 7) is composed of a lever 200 pivoted at 201 to the standard 13. A free end 202 of said lever 200 is threaded and projects out from standard 13 by opening 107. A bush 203 is screwed onto the free end 202 of lever 200. The other end 204 of lever 200 is connected to a second lever 205 by a rod 40. The second lever 205 is fixed to a shaft 207, a free end of shaft 207 being fixed to a block 208 having a slide 209. The free end 105 of the lever 205 is in contact with the plate 41 free to oscillate at 42. Two square blocks 210 pivoted to an end of rod 211 slide in 209. The other end of rod 211 is pivoted to a connecting rod 212 pivoted to 213 which is connected to the bed 11 of the sewing machine. An eccentric 214 fixed on shaft 215 moves rod 211 by a forked connecting rod 216 so that two square blocks 210 slide in the slide 209. This motion of the rod 211 causes the swing of the connecting rod 212, which swing is transmitted by a rod 217 to the feeding shaft 18 and from shaft 18 to lever 20. In FIG. 7 the stitch length regulator has been drawn with a length feed value corresponding to 0. When the operator unscrews the bush 203 on the free end 202 of the lever 200, lever 200, rod 40 and lever 205 move and shaft 207 rotates on its axis a portion corresponding to the oscillation of the free end 202. Also block 208 rotates and so the rod 211 accomplishes a greater axial stroke so that the oscillation of the connecting rod 212 is increased. When the operator pushes down the free end 202 of lever 200 in the direction of arrow A, a feeding reversal is obtained. When the operator releases the free end 202, spring 218 rotates lever 200 around the pin 201 causing bush 203 to press against standard 13.

Figure 5:
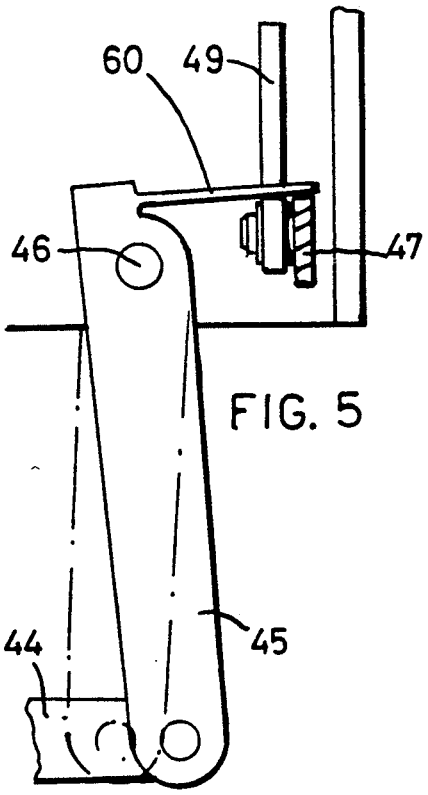
FIGS. 4 and 5 show in detail the control means for effecting the feeding reversal.
Figure 3:
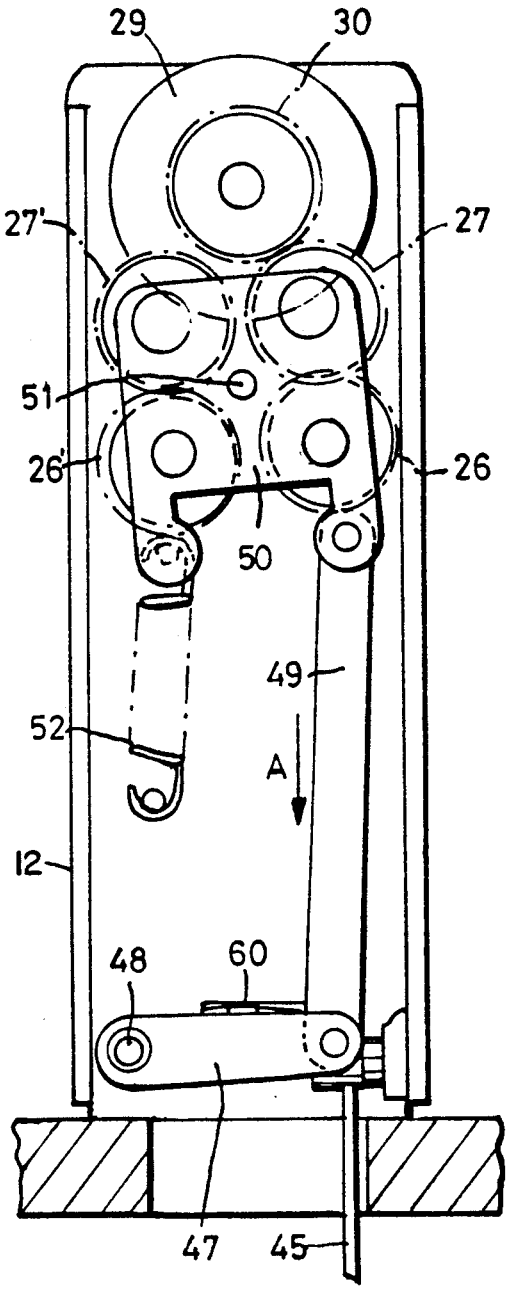
FIGS. 2 and 3 show in detail the operating mode of the wheel feeding.
Figure 2:
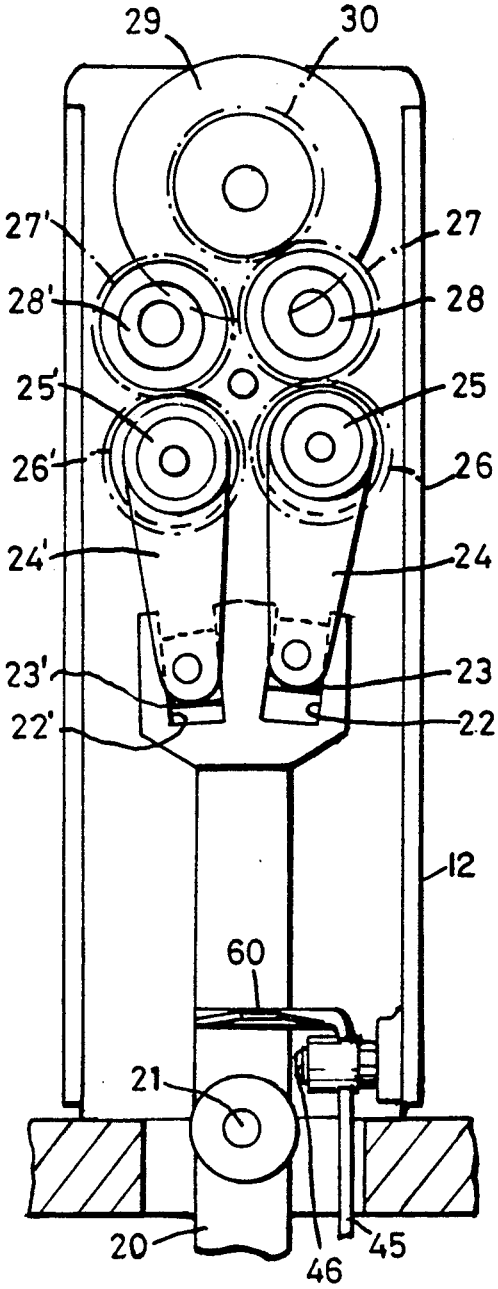

The plate 41 is pivotally connected to one end of a rod 44 (FIGS. 1, 4 and 5) which runs in the bed 11. The other end of the rod 44 is pivotally connected to an element 45 pivoted at 46 at the column 12 (FIGS. 2, 3 and 5). The element 45 presents a lug 60 which engages a connecting rod 47 pivoted at one end at 48 at the column 12 and at the other end to one end of the lever 49. The other end of lever 49 engages a support 50 (FIG. 3) pivoted at 51 in the column 12. To support 50 there are fixed, free to rotate, the free release wheels 25, 25', 28 and 28' and the corresponding gears 26, 26', 27 and 27'.

When the feeding direction is desired to be reversed, the operator pushes downwardly the stitch length regulator device 19. By this displacement also the rod 40 is pushed downwardly and, applying a pressure on the inclined plane 43, causes the plate 41 to rotate around the pin 42 in the position illustrated in FIG. 4 with a dotted line. This rotation causes a displacement of the rod 44 and as a consequence a rotation of the element 45 around the pin 46. The rotation of element 45 causes, by means of the lug 60, a pressure on the connecting rod 47 which makes a clockwise downwardly rotation with respect to the pin 48 (FIG. 3). The rotation of the connecting rod 47 causes a displacement of the lever 49 in the direction of arrow A and as a consequence, the support 50 rotates around the pin 51 until the gear 27' comes into contact with the gear 30 of the feeding wheel 29.

As previously described, the gear 27' rotates in the opposite direction with respect to the gear 27, therefore the wheel 29, driven by the gear 27', reverses its rotational direction and thus feeds the work in the opposite direction with respect to the normal feeding direction.

When the operator releases the stitch length regulator device 19, the lug 60 of the element 45 stops pressing on the connecting rod 47. A pull off spring 52 (FIG. 3), meeting no resistance, carries the support 50 again into the initial position, that is the gear 27 is in contact with the gear 30 of the wheel 29 in such a way that wheel 29 can feed the work along the normal sewing direction.

Thus, the stitch length regulator 19 moves from an initial position of maximum stitch length downwardly to a position of minimum stitch length and further downwardly to a position where the reversal of the direction of movement of the fabric feed lower wheel takes place after which the spring 52 returns the stitch length regulator device 19 to its initial position.

I claim:

1. A wheel low fabric feeding system for sewing machines comprising a feeding wheel, a stitch length regulator device, an oscillating feeding shaft whose oscillations are regulated by said stitch length regulator device and means to transmit said oscillations of said feeding shaft to said feeding wheel, said means to transmit comprising a first lever operated by said feeding shaft, a pivotal support mounted on said sewing machine, free release wheels fixed to said support, two gear couples mounted on said free release wheels and means connected to said support for engaging one of said gear couples to said low feeding wheel in order to reverse the direction of rotation of said low feeding wheel.

2. The wheel low fabric feeding system according to claim 1 including a first rod fixed at one end to said stitch length regulator device, a rotatable plate, said rotation of said plate governed by the movement of the other end of said first rod, a second rod pivotally connected at one end to said plate, an element pivotally connected to the other end of said second rod, a connecting rod engaged by said element and a second lever engaging at one end said support and at the other end said connecting rod, the displacement of said stitch length regulator device being transmitted to said support when said device is activated for reversing the rotational direction of said feeding wheel.

3. The wheel low fabric feeding system of claim 2 including a pull-off spring connected to said support and said sewing machine to disengage one gear couple and bring the other gear couple into engagement with said low fabric feeding wheel when said stitch length regulator device is released.

4. The wheel low fabric feeding system of claim 2 wherein said plate defines an inclined plane which movement is governed by the movement of the other end of said first rod, said first rod acting to force movement of said inclined plane when said stitch length regulating device is activated to cause rotation of said plate.

5. The wheel low fabric feeding system of claim 4 wherein said element defines a lug in contact with said connecting rod for transmitting to said connecting rod the rotation of said plate.

* * * * *